US005950673A

United States Patent [19]

Elliott-Moore

[11] Patent Number: 5,950,673

[45] Date of Patent: Sep. 14, 1999

[54] VALVES

[75] Inventor: Peter Elliott-Moore, Stoke-on-Trent, United Kingdom

[73] Assignee: Joy MM Delaware, Inc., Wilmington, Del.

[21] Appl. No.: 09/017,955

[22] Filed: Feb. 3, 1998

[30] Foreign Application Priority Data

Dec. 9, 1997 [GB] United Kingdom ..... 9725915

[51] Int. Cl.[6] ..... F15B 13/042

[52] U.S. Cl. ..... 137/596.18; 91/447

[58] Field of Search ..... 91/447; 137/596.18

[56] References Cited

U.S. PATENT DOCUMENTS 4,624,455 11/1986 Putnam ..... 91/447 X 5,400,816 3/1995 Gerstenberger ..... 91/447 X 5,738,142 4/1998 Eike et al. ..... 91/447 X

*Primary Examiner*—Gerald A. Michalsky

*Attorney, Agent, or Firm*—Alastair W. Neill; James Earl Lowe, Jr.

[57] ABSTRACT

A pilot operated check valve is provided for use in controlling the hydraulic leg 14 of a hydraulic mine roof support, the valve having means 23 to connect a leg extension port 18 to a return port 17 within the valve, when the valve is used to lower the leg 14. This provides more rapid operation than with prior art arrangements in which released pressure from the leg has to return from an extension port back to a remote spool valve controlling leg extension before reaching a return line.

2 Claims, 3 Drawing Sheets

VALVES

The invention relates to valves and particularly to valves for use in controlling the support legs of hydraulic mine roof supports.

Hydraulic mine roof supports are well known and generally comprise a ground engaging base, a roof engaging canopy, and a plurality of support legs each comprising a hydraulic jack acting between the base and the canopy.

A new generation of larger diameter legs is being developed to meet customer demands for higher rated supports. The flow capabilities of current control systems are at their limits and it is becoming increasingly necessary, to match the operating cycle time of the supports to the cutting rate of modern coal shearing machines, to provide additional boost valves.

The valves that are presently used to control the legs are known as pilot operated check valves. These are generally mounted directly to the legs and normally lock pressure in the head side of the cylinder of the hydraulic jacks. Leg extension and leg closure is controlled by the application of pressure to extension and closure ports of the valve. The delivery of fluid to the ports is controlled by spool valves.

When a leg is lowered using the present valves, the released pressure from the leg has to return from the extension port back to the spool valve controlling leg extension before reaching a return line.

The invention provides a pilot operated check valve for use in controlling the hydraulic leg of a hydraulic mine roof support, the valve having means to connect a leg extension port to a return port within the valve when the valve is used to lower a leg.

Preferably, the connection is brought about by the movement of a piston within the valve.

The piston may have a plurality of radial holes which are normally separated from a return port by a seal but which may be brought into communication with the return port by movement of the valve member such that the radial holes move past the seal.

By way of example, a specific embodiment of the invention will now be described, with reference to the accompanying drawings, in which.

Figure 1:
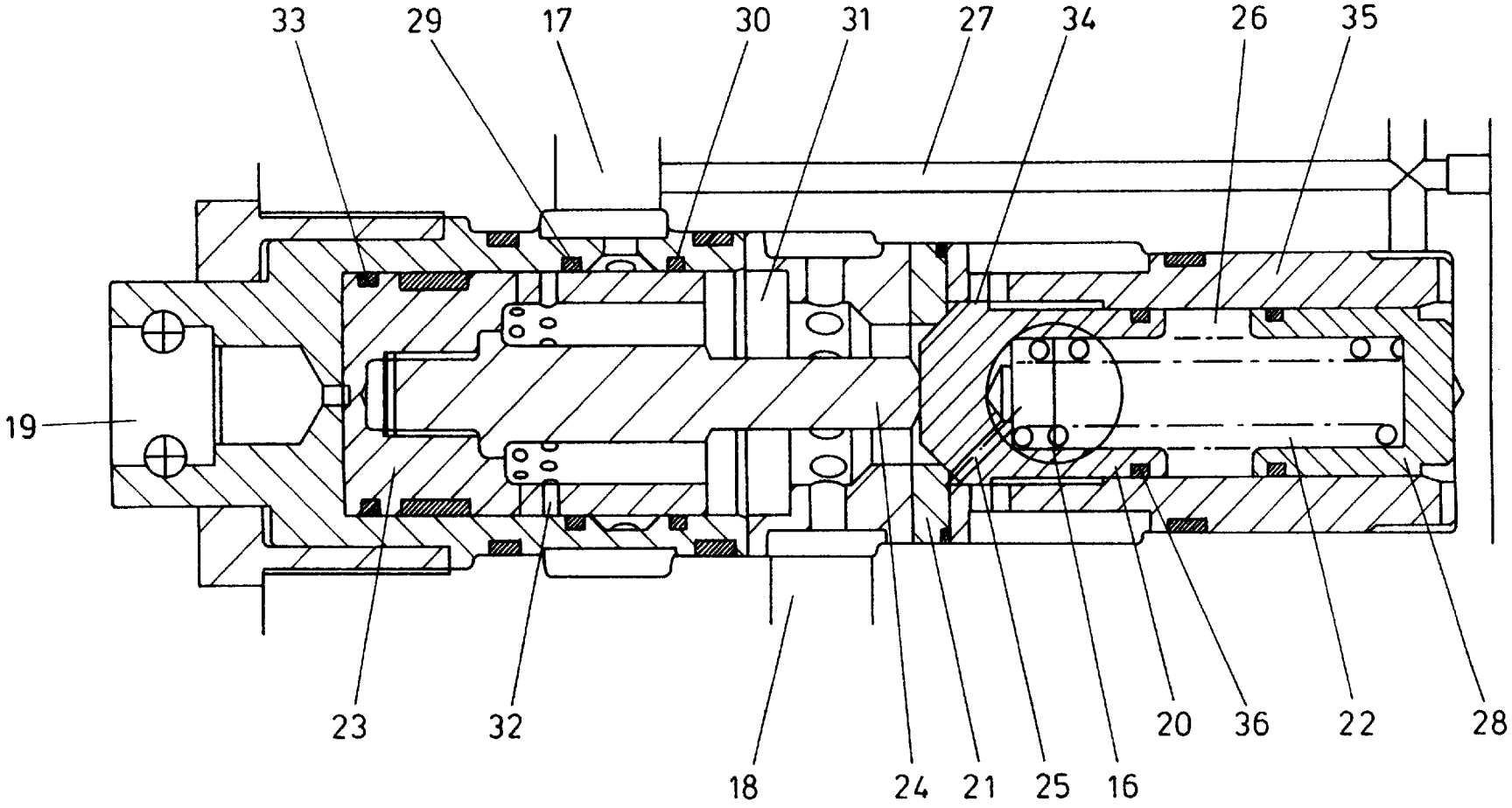
FIG. 1 is a cross-sectional view through an embodiment of pilot operated check valve according to the invention.
Figure 2:
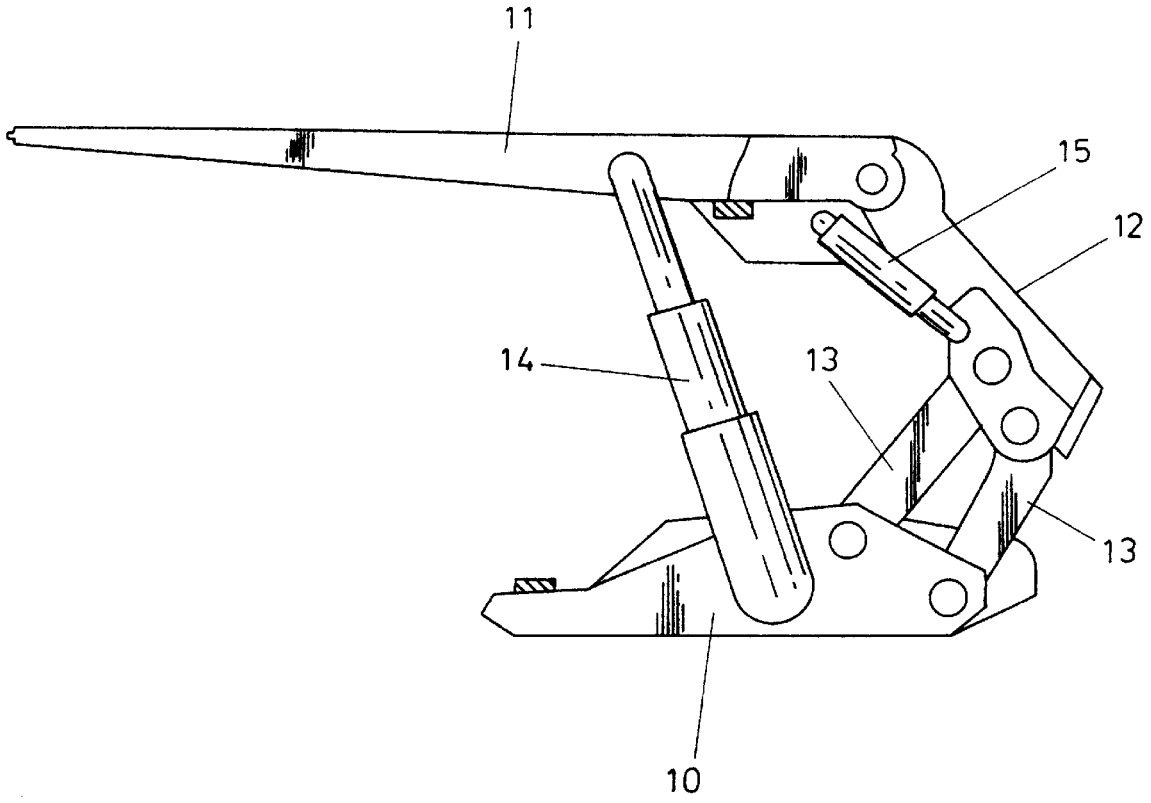
FIG. 2 is a view of a typical hydraulic mine roof support with which the valve may be used.

The valve shown in cross-sectional detail in FIG. 1 is intended to be used with hydraulic mine roof supports and a typical mine roof support is shown in FIG. 2. The support has a ground engaging base 10 and a roof engaging canopy 11, interconnected by a rear shield 12 and pivoting links 13. A pair of hydraulic support legs 14 act between the base 10 and the canopy 11. The angle between the canopy 11 and the shield 12 is controlled by a compensating ram 15 which can be hydraulically locked.

The valve shown in FIG. I may be used with one or more of the legs. The valve has four ports. Port 16 is connected to the leg and port 17 is connected to a pressure return line.

When it is desired to raise the leg, pressure is applied to a port 18 under the control of a spool valve (not shown). When it is desired to lower the leg, pressure is applied to a port 19 using another spool valve (not shown).

FIG. 1 shows the valve in its normal position, which it will adopt when the canopy 11 is set to the mine roof and support pressure is trapped in the legs.

Under these conditions, there will be no pressure at port 18 and the first valve member 20 is pushed against a valve seat 21 by a force applied by a compression spring 22. The seal formed between the cone of the valve 20 and the seating edge of 21 prevents fluid from escaping from the leg cylinder. A pilot piston 23 is also maintained in the position shown in FIG. 1 by a spring 22, since the valve member 20 abuts against a stem 24 of the pilot piston 23.

The tendency for the roof and floor of the mine working to converge causes leg pressure to build up during mining operations and this build up of pressure at port 16 bleeds through a passage 25 and into a chamber 26 so this pressure is therefore felt by the tail of the valve member 20. Thus the seating force of the valve member 20 increases proportionally with increase in leg pressure.

The pressure in the return line is fed via drillings 27 in the body of the valve to act on a piston 28 at the right hand end of the valve. This exerts a force compressing the spring 22 if the return line pressure is higher than the leg pressure in chamber 26, thus increasing the seating force applied to the valve member 20. As the area of the piston 28 acted upon by the return pressure is greater than the area of the cone end of the valve 20, which cone end is similarly pressurised by the pressure in the return line, the resulting force imbalance provides a positive seating force which prevents an elevated return pressure from extending the leg. Seals 29 and 30 prevent pressure at the return port 17 from feeding into a gallery 31. However as the spool valves controlling ports 18 and 19 are connected to the return line in the unoperated position, return pressure is felt at either end of the pilot piston 23 and therefore the forces on the pilot piston 23 are balanced. Thus it is not possible for return pressure acting on piston 23 to lift the valve 20 off its seat 21.

Leg extension will now be described.

Pressure from the leg set spool valve (not shown) is fed to port 18 and into the gallery 31. It therefore acts against the pilot release valve 23 and the first valve member 20. The pilot valve 23 is sealed to prevent pressure escaping through radial holes 32 by the seal 29. Another seal 33 prevents the pressure from leaking to port 19 and seal 30 prevents pressure from leaking to the return port 17. Thus the force exerted by the pressure maintains the pilot valve 23 in its normal position.

Pressure in the gallery 31 also acts over the cone end of the valve member 20 exerting a force attempted to push the valve member 20 off its seat 21. This force is resisted by a combination of:

(a) the force of compression spring 22;

(b) the force exerted by leg pressure acting over the seat area; and (c) the force exerted by return acting over the area of piston 28 if the return pressure is higher than leg pressure.

When the force generated by the pressure in the gallery 31 on the cone end of the valve member 20 exceeds the resisting forces the valve member 20 opens, allowing pressure to feed into the port 16 and to the cylinder head side of the leg, allowing the leg to extend. The flow to the leg is initially restricted as the flow path is through the annular gap 34 between the valve member 20 and the bore of a valve guide 35. This reduces the velocity of flow between the valve cone and the seat 21 as the valve member 20 lifts from the seat 21.

Pressure in the valve also feeds through a passage 25 into the chamber 26 between the valve member 20 and the piston 28. Thus the pressure forces acting on valve member 20 are balanced and the pressure loss through the valve is a function of the size of the equivalent open orifice, dependant on the displacement of valve member 20, plus the spring force.

When the leg set signal is turned off the set spool valve returns to its normal service to return position. Thus the pressure at port 18 and in the gallery 31 reduces. The pressure acting against the cone surface of the valve member 20 similarly reduces resulting in a force imbalance across the valve returning the valve to its seated position as shown in FIG. 1 and locking pressure in the head side of the leg. Leg release operation will now be described.

Pressure from a power lower spool valve (not shown) is fed to port 19 and acts over the area of pilot piston 23. Pressure is prevented from escaping to return by the seal 33. Thus the pilot piston 23 exerts a force, which is transmitted by the spherical end of stem 24 against the cone end of the valve member 20, thus lifting the valve member 20 of its seat 21. The area of the pilot piston 23 is greater than the area of seat 21, thus allowing the valve 20 to be opened at a pressure lower than leg pressure. The pilot pressure at which the valve member 20 lifts off its seat 21 is a function of leg pressure at port 16, and return pressure in gallery 31, friction, and the force exerted by compression spring 22.

As the valve lifts from its seat, the initial rate of discharge is limited by the throttled area 34. Thus the velocity of flow through the small opening is reduced to preserve the life of the seat 21. The discharge flow is fed into the gallery 31 and out through port 18 back through the leg set spool valve to return.

The flow force effects resulting from the reduction in static pressure at the surface of the cone as the valve member 20 starts to lift are reduced by the bleed passage 25. This attempts to maintain the pressure in the chamber 26 at the same level as the pressure felt on the surface of the cone, thus reducing the sudden closing force felt by the valve member 20. Any hesitation is counteracted by the damping effect of the column of fluid in the chamber 26 and seal friction from a seal 36.

As the valve lifts further, the radial holes 32 in the pilot piston 23 traverse the seal 29 to a position that opens up a path from gallery 31 to the return port 17. Thus a path is opened directly to the return line, within the valve, in parallel with the path from the port 18 back through the set spool valve.

When the signal to lower the legs is turned off, the pressure at port 19 is decayed reducing the force holding valve member 20 open. Valve member 20 begins to close once the force generated by pressure at 19 is less than the pressure and spring forces acting in the opposite direction on valve member 20. As the valve member 20 returns to its seat 21, the force is transmitted through the spherical end of the stem 24 to the pilot piston 23. Thus, the radial holes 32 in the pilot piston 23 traverse the seal 29 shutting off the internal dump to return. Finally valve member 20 makes contact with its seat 21 sealing off the path to return from the leg collection to port 18, again locking pressure in the leg cylinder.

In use, the valve assembly may be bolted to the side of a leg cylinder. Port 16 links the leg pressure side of the seat 21 to a flow passageway in the wall of the cylinder. Pressure at the interface is sealed by an O-ring housed in a groove at 16. Ports 17 and 18 fall in a plane perpendicular to the axis of the cylinder so that hose connections can be made. The passage 25 is an angled drilling in the cone face of the valve member 20. Leg pressure from port 16 has to pass through radial holes in the valve guide 35 and the annular gap between the valve member 20 and the valve guide 35 before reaching the passage 25.

The port 18 is connected by a length of flexible hose to the leg set spool valve. This may be a two-position three way control valve normally connected to return. Thus, when the support is not setting the canopy against the roof, the port 18 is linked to return. This is fed into the gallery 31 by a series of radial holes and hence the return pressure acts over the cone face of the valve member 20.

The details of the apparatus shown could be changed with departing from the scope of the invention. For example there could be more than four ports. Additional leg ports could be included, for example to enable pressure transducers to be connected.

Figure 3:
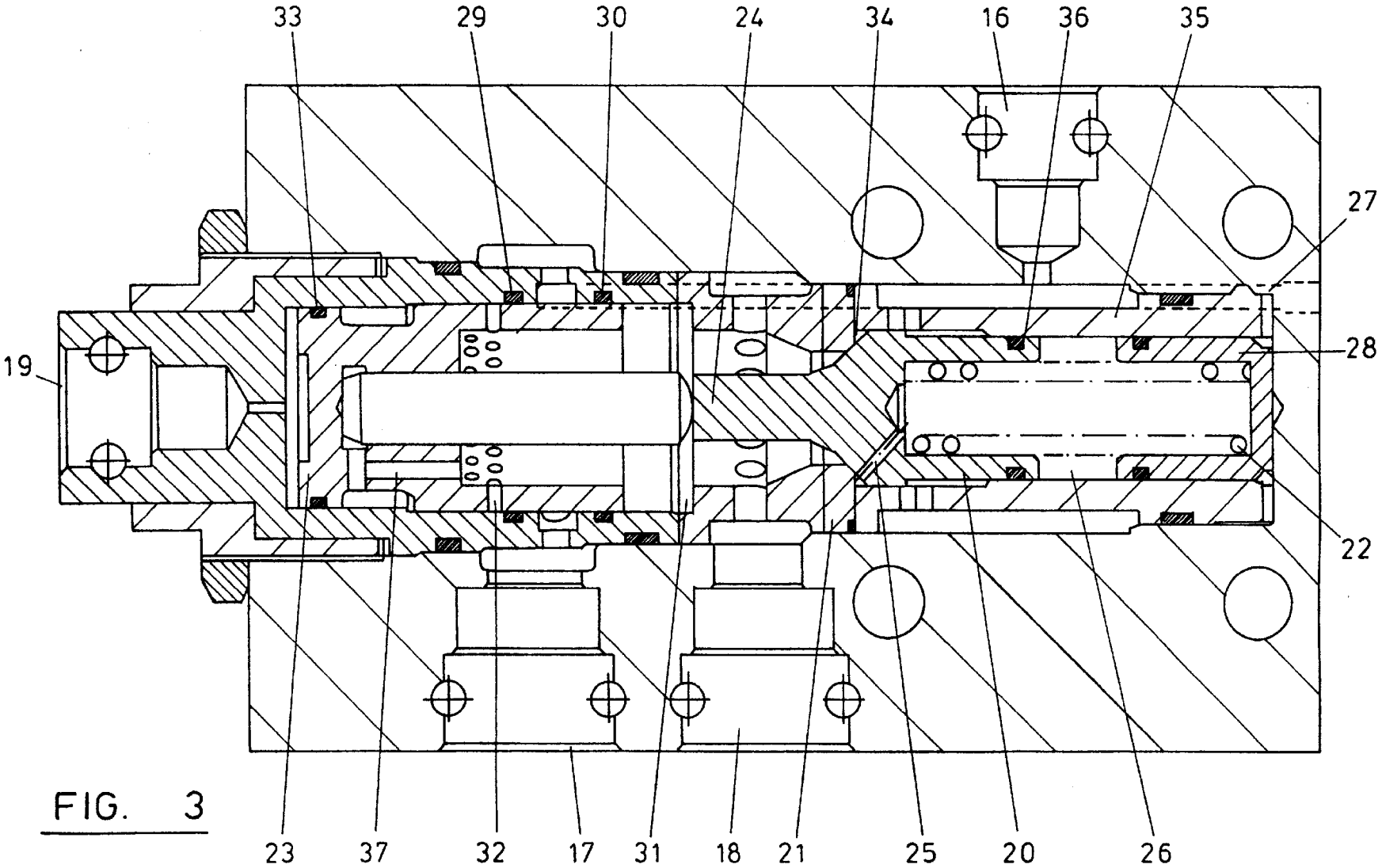
FIG. 3 is a view similar to FIG. 1 but showing an alternative embodiment of pilot valve.

FIG. 3 shows an alternative embodiment of the valve which is substantially identical to the embodiment shown in FIG. 1 and like reference numerals are used to indicate like components. The principle difference is the ports 17 and 18 extend in parallel directions, port 16 extending in the opposite direction.

Furthermore, the stem 24 is split into two parts, one being an integral part of valve member 20 and one being part of the pilot piston assembly 23.

Also, an additional passage 37 is provided to ensure that pressure between seals 33 and 29 can never be higher than the pressure in the radial holes 32 whilst the holes are traversing the seal 29. This reduces the likelihood of the seal 29 failing prematurely.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

I claim:

1. A pilot operated check valve adapted to be connected to a hydraulic support leg, the valve comprising a valve housing including a supply port, a leg extension port, a fluid return port, and a leg lowering pilot port, a check valve in said housing between said supply port and said leg extension port, said check valve permitting fluid flow from said supply port to said leg extension port and preventing fluid flow from said leg extension port to said supply port, a return path in said valve housing between said supply port and said fluid return port, and a pilot piston slidable in said valve housing between a first position and a second position, the pilot piston blocking the return path when in said first position and not blocking the return path when in said second position, said pilot piston being in communication with said leg lowering pilot port being responsive to pressure at said leg lowering pilot port to move from said first position to said second position and to engage and to open said check valve.

2. A pilot operated check valve in accordance with claim 1 wherein said pilot piston is hollow and the interior of said pilot piston is in fluid communication with said supply port, and wherein movement of said pilot piston opens the return path by said piston having a plurality of radial holes which are normally separated from said fluid return port by a seal, but which are brought into fluid communication with the fluid return port by movement of the pilot piston.

* * * * *